US007497439B2

(12) United States Patent
Leupp et al.

(10) Patent No.: US 7,497,439 B2
(45) Date of Patent: Mar. 3, 2009

(54) GAMING DEVICE AND METHOD FEATURING CHESS INDICIA

(75) Inventors: Jon Leupp, Henderson, NV (US); Kim Tempest, Henderson, NV (US)

(73) Assignee: Aristocrat Technologies Australia Pty Ltd, Lane Cove, New South Wales ( * ) Notice: Subject to any disclaimer, the term of this patent is extended or adjusted under 35 U.S.C. 154(b) by 0 days.

(21) Appl. No.: 11/502,756

(22) Filed: Aug. 11, 2006

(65) Prior Publication Data

US 2007/0085266 A1 Apr. 19, 2007

Related U.S. Application Data

(62) Division of application No. 10/793,988, filed on Mar. 4, 2004, now abandoned.

(51) Int. Cl.
*A63B 71/00* (2006.01)

(52) U.S. Cl. ..... 273/138.1

(58) Field of Classification Search ..... None
See application file for complete search history.

(56) References Cited

U.S. PATENT DOCUMENTS 5,660,388 A * 8/1997 Benn ..... 273/241
6,290,600 B1 * 9/2001 Glasson ..... 463/20
6,364,766 B1 * 4/2002 Anderson et al. ..... 463/16
6,443,837 B1 * 9/2002 Jaffe et al. ..... 463/16
6,461,241 B1 * 10/2002 Webb et al. ..... 463/20
6,506,114 B1 * 1/2003 Estes et al. ..... 463/16
6,551,187 B1 * 4/2003 Jaffe ..... 463/20
6,561,904 B2 * 5/2003 Locke et al. ..... 463/25
6,585,264 B2 * 7/2003 Benett ..... 273/143 R
6,589,114 B2 * 7/2003 Rose ..... 463/20
6,764,398 B2 * 7/2004 Stone et al. ..... 463/25
6,875,106 B2 * 4/2005 Weiss et al. ..... 463/20
6,960,134 B2 * 11/2005 Hartl et al. ..... 463/20
2002/0039918 A1 * 4/2002 Anderson et al. ..... 463/16
2003/0054875 A1 * 3/2003 Marks et al. ..... 463/20
2004/0038731 A1 * 2/2004 Englman ..... 463/25
2005/0253331 A1 * 11/2005 Leupp et al. ..... 273/138.1
2006/0003827 A1 * 1/2006 Hartl et al. ..... 463/9
2006/0009277 A1 * 1/2006 Hartl et al. ..... 463/20

* cited by examiner

*Primary Examiner*—Gene Kim
*Assistant Examiner*—Dolores Collins
(74) *Attorney, Agent, or Firm*—Audrey A. Millemann; Weintraub Genshlea et al.; Bernhard Kreten

(57) ABSTRACT

A gaming device and method directed to a primary game having chess pieces displayed in the primary game outcomes. After completion of the primary game, the chess pieces "move" according to chess movement rules to "capture" other chess pieces. Credits are awarded for each "capture". Embodiments include activation of all chess pieces for play or activation of individual types of pieces based on player wagering.

7 Claims, 5 Drawing Sheets

Example result with 3 captures ( blank squares contain non-chess place symbols )

Example result with 20 captures

GAMING DEVICE AND METHOD FEATURING CHESS INDICIA

CROSS-REFERENCE TO RELATED APPLICATION

This application is a divisional of prior application Ser. No. 10/793,988 filed on Mar. 4, 2004, now abandoned, pursuant to 35 U.S.C. § 121, and hereby incorporates that application by reference.

FIELD OF THE INVENTION

The following invention is generally related to instrumentalities and methodologies in gaming devices. More specifically, the instant invention is directed to a method and apparatus for gaming that provides a primary game and a secondary game. After winning outcomes from the primary game are awarded, special indicia on the playfield move to other positions on the playfield according to a rule set. Special indicia having particular ending positions generate an award for the player.

BACKGROUND OF THE INVENTION

Patrons of gaming establishments are constantly searching for new games of interest. This trend has prompted the development of thousands of new types of games to attract players. Several games offer a bonus game feature, which allows a player to play a secondary game subsequent to the primary game. The secondary game, or "bonus game" usually enjoys a separate paytable and a chance for the player to win enhanced awards. Such bonus games often involve games different from the primary game, including different screens and symbols.

The following prior art reflects the state of the art of which applicant is aware and is included herewith to discharge applicant's acknowledged duty to disclose relevant prior art. It is stipulated, however, that this reference does not teach singly nor render obvious when considered in any legally conceivable combination the nexus of the instant invention as disclosed in greater detail hereinafter and as particularly claimed.

| PATENT NO. | ISSUE DATE | INVENTOR |
|---|---|---|
| 6,585,264 | Jul. 1, 2003 | Benett |

Benett discloses a "gaming machine having a chess game feature". Chess pieces in Benett move according to traditional chess rules. Only one move is made, and the direction of the move may be randomly chosen (column 2, lines 10-14). Each piece moves without regard to other pieces present and thus, does not interact with other pieces in any manner. The symbol occupying the landing position of the moving chess piece may be transformed into the same chess piece as the moving piece. That is, when a rook moves, it transforms all underlying symbols during its move into rooks (column 4, lines 21-24). Substituted and original chess pieces are then used in re-evaluating each payline against the internal paytable.

SUMMARY OF THE INVENTION

The present invention is distinguishable over the prior art in a multiplicity of ways. A primary game is played and the player is awarded for any winning outcomes. Included in the primary game outcomes are special indicia that may be nominated in a bonus game (secondary game) or as an adjunctive feature of the primary game. Preferably, the special indicia are chess pieces. After play of the primary game is complete and outcomes deemed winning on a paytable are reconciled, any special indicia present can move about the playfield according to a rule set, preferably according to traditional movement rules in chess. There are different types of special indicia, each having its own movement rule. Each movement is evaluated separately. If a move results in coincidence of two special indicia, the player is rewarded. All possible movements of each of the special indicia are evaluated for winning outcomes.

One embodiment contemplates activation of all types of special indicia for movement during the bonus game, while another embodiment enables each type of special indicia with increasing wagers made by the player. Rules for placement of special indicia may also vary, for example, by allowing either single or multiple special indicia to be displayed in a single reel in an outcome.

OBJECTS OF THE INVENTION

Accordingly, it is a primary object of the present invention to provide a new and novel device and method for entertaining players in a gaming environment.

It is a further object of the present invention to provide a device and method as characterized above in which familiar themes are presented to enhance player interest.

It is a further object of the present invention to provide a device and method as characterized above which provides a bonus game that does not require supplemental apparatus for implementation.

It is a further object of the present invention to provide a device and method as characterized above that allows a player to increase the chance of winning by placing additional wagers, which affect the total number of favorable outcomes in the secondary game.

It is a further object of the present invention to provide a device and method as characterized above in which a primary game and a bonus game are played using the same indicia on the same playfield.

Viewed from a first vantage point, it is an object of the present invention to provide a gaming device, comprising, in combination: a visual display; a wagering means operatively enabling said visual display; and means for changing said visual display as a function of the appearance of a first chess piece and a second chess piece if the first chess piece can move in a preordained manner and occupy the position of the second chess piece.

Viewed from a second vantage point, it is an object of the present invention to provide a method for gaming, the steps including: accepting a wager; activating a display; generating and displaying outcomes on the display, the outcomes comprising symbols, wherein a subset of the symbols are enabled for movement according to a rule set; moving each of the subset of symbols according to the rule set; determining whether the position of any one of the subset of symbols can coincide with the position of any other of the subset of symbols; and awarding credits for coincident positions.

These and other objects will be made manifest when considering the following detailed specification when taken in conjunction with the appended drawing figures.

DESCRIPTION OF PREFERRED EMBODIMENTS

Figure 2:
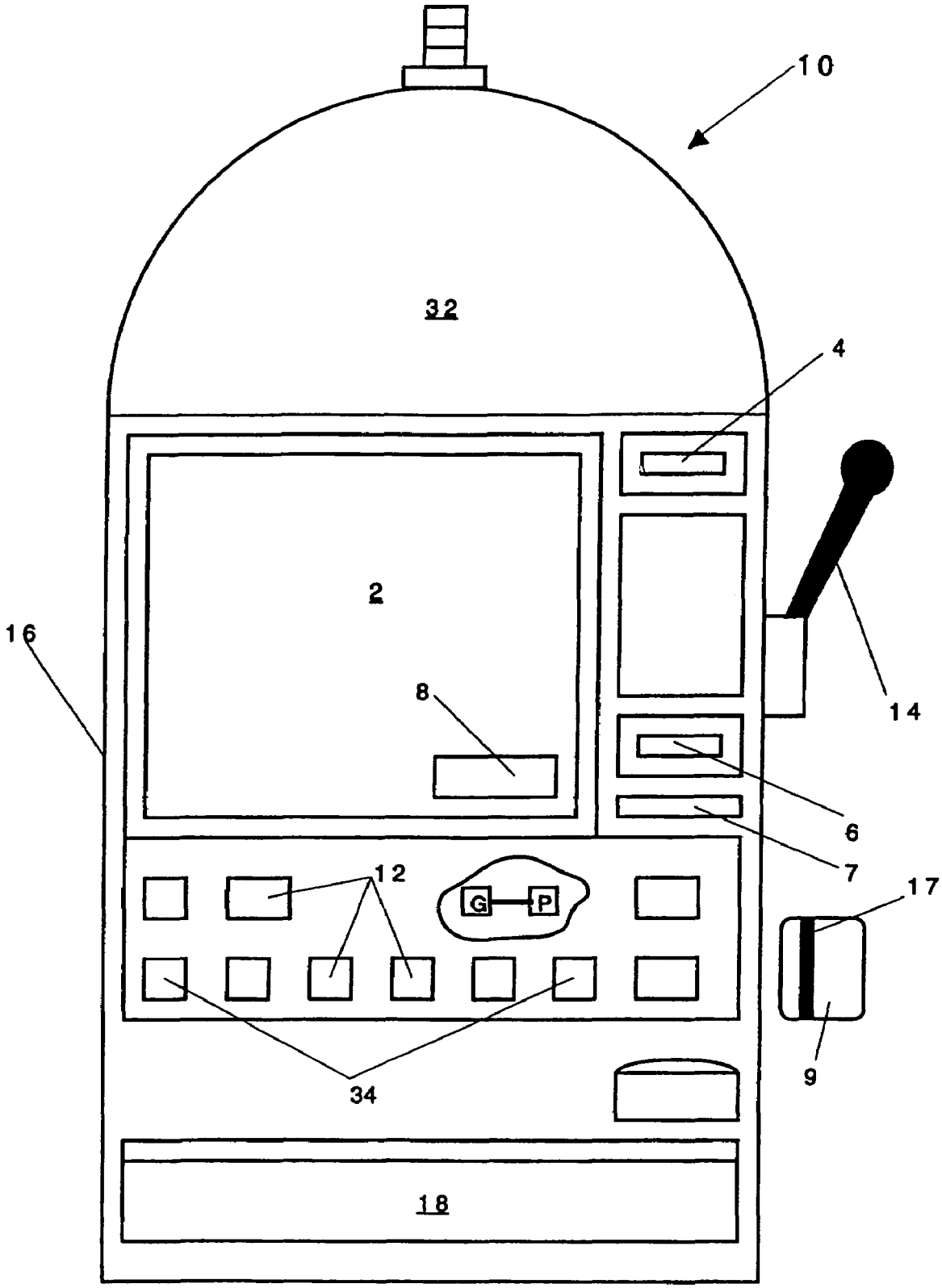
FIG. 2 is a depiction of the apparatus associated therewith.

Considering the drawings, wherein like reference numerals denote like parts throughout the various drawing figures, reference numeral 10 as shown in FIG. 2 is directed to the device according to the present invention.

In its essence, the device 10 includes a housing 16 which supports a visual display 2, preferably a video monitor, therewithin. The display 2 may include a window 8 for special messages or for incrementing counting of credits accumulated by the player. The device also includes an LED or other readout 4 for prompting the player and can provide similar verbiage as the window 8 or in lieu thereof, to stimulate the player. The device includes an inlet 6 for the reception therein for coins, currency or the like to auger in the inception of play. A plurality of decision-making buttons 12 are located on the face of the apparatus 10, preferable below the display 2, and a pull handle 14 can be used to initiate play as an alternative to supplement the decision-making buttons 12. A coin hopper 18 or other payment methods, i.e., ticket printers, may be included to effectuate an output of an award due the player. The device 10 may have a top portion 32 with a display thereon having a motif correlative with the game to be played and can include a paytable. A plurality of speakers 34 may be included on the device for aural interaction with the player. The apparatus also includes a processor P coordinating all functions and a random number generator G operatively coupled thereto for generating outcomes. A card 9, having a read/write instrumentality 17 thereon, can be read via input 7 as a substitute for or supplement to credit transfers as well as player identification.

Figure 3:
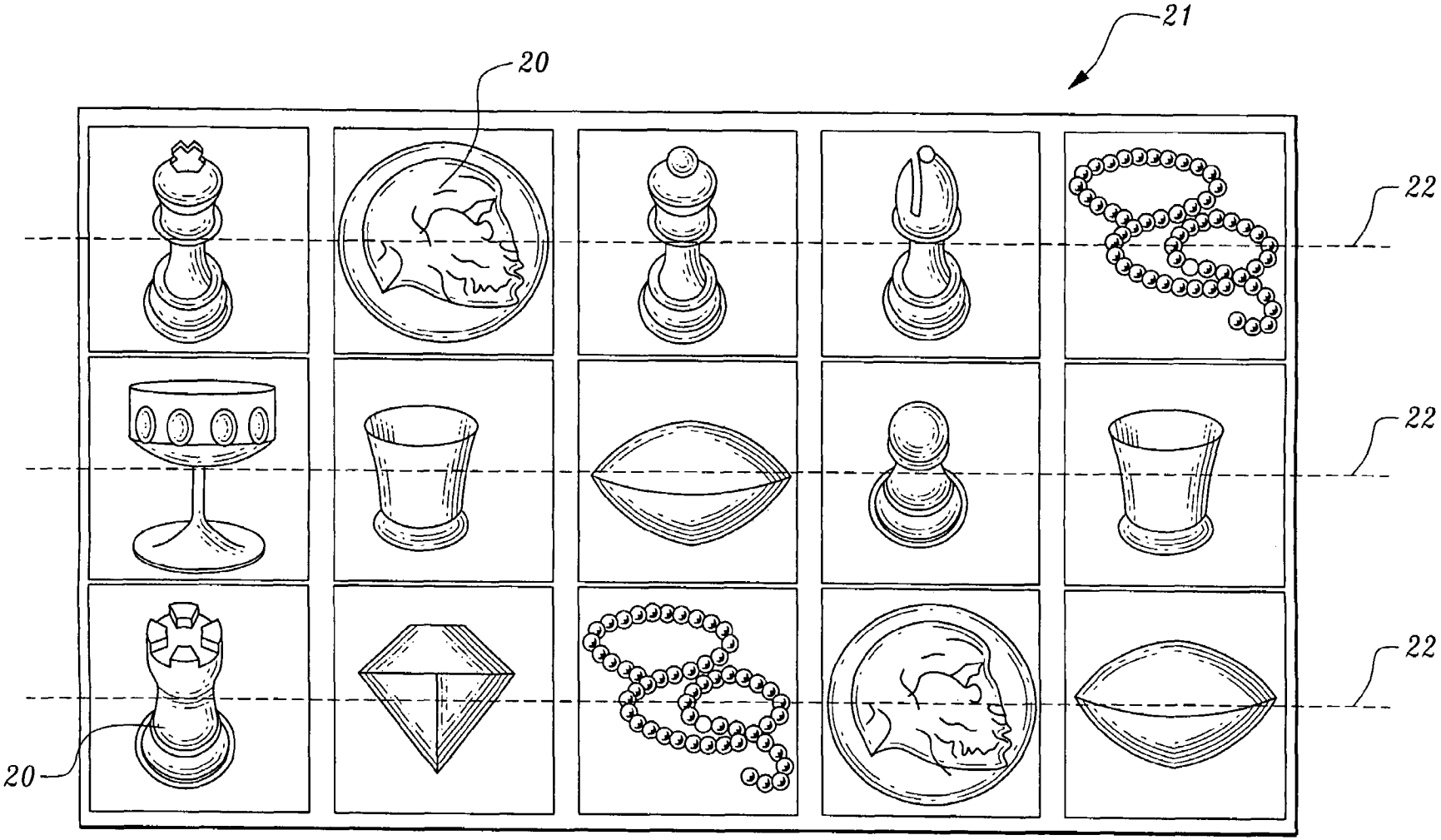
FIG. 3 is a depiction of a 3×5 matrix playfield.

More specifically, and with reference to FIG. 3, greater details with respect to the video display 2 can be explored. The display 2 features a plurality of symbols 20 arranged in a primary row and column (RXC) matrix 21, corresponding to a primary game. Paylines 22 correspond to areas on the primary matrix 21 in which winning combinations may be located. The primary game is preferably a reel-type game, well known in the art, with multiple paylines, displaying three rows on five reels (a 3×5 matrix).

Figure 1:
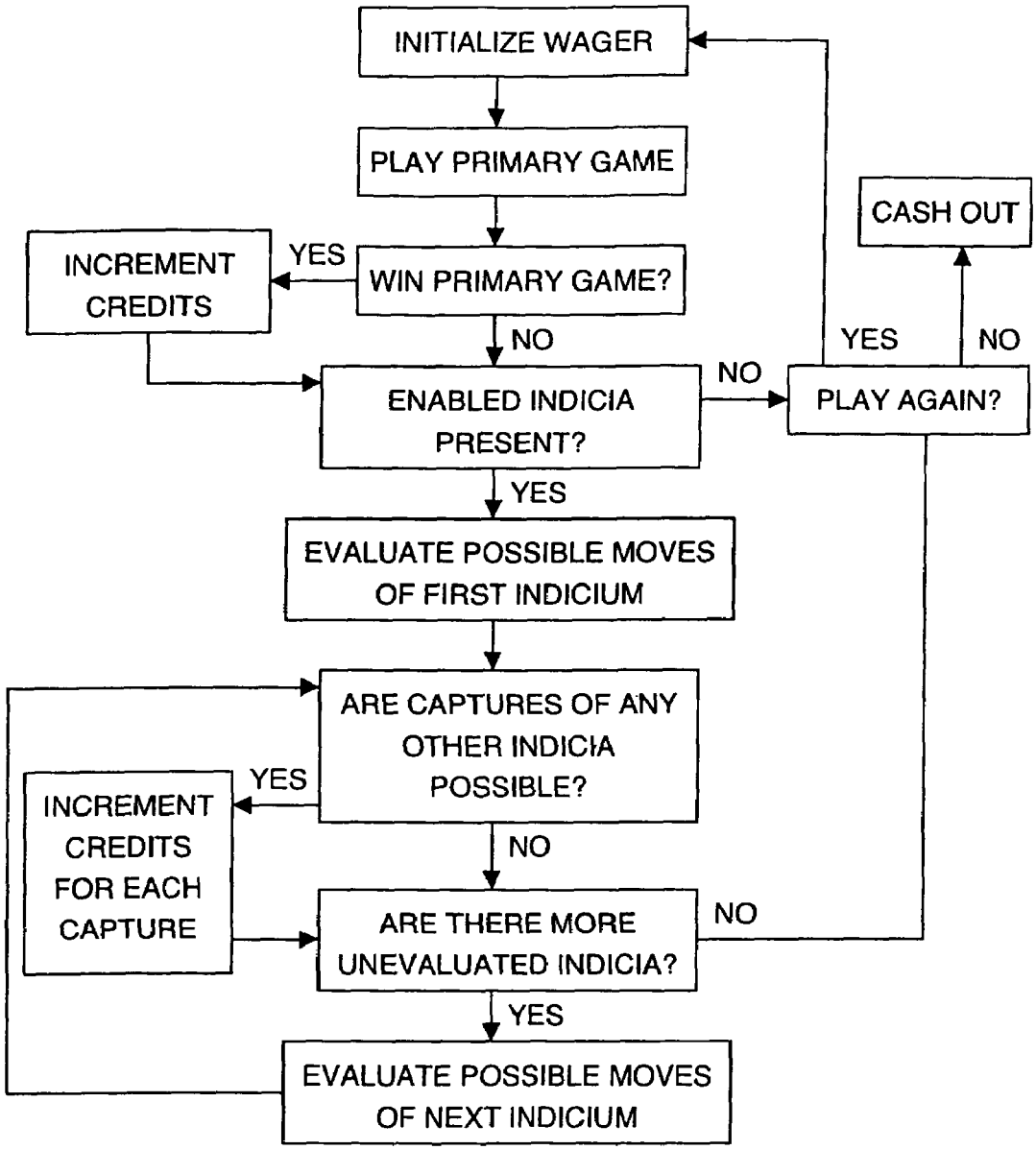
FIG. 1 is a flowchart of the methodology according to the present invention.

Referring to FIG. 1, the flow chart associated with the apparatus of FIGS. 2 and 3 can be explored. The gaming device is enabled with a wager. Preferably, a maximum bet enables the features of the invention. Assume a maximum wager is placed. A primary game is played in a conventional fashion, with awards determined by a paytable. For example, an activated payline displaying three "7" symbols or three "BAR" symbols would generate an award for the player.

Figure 4:
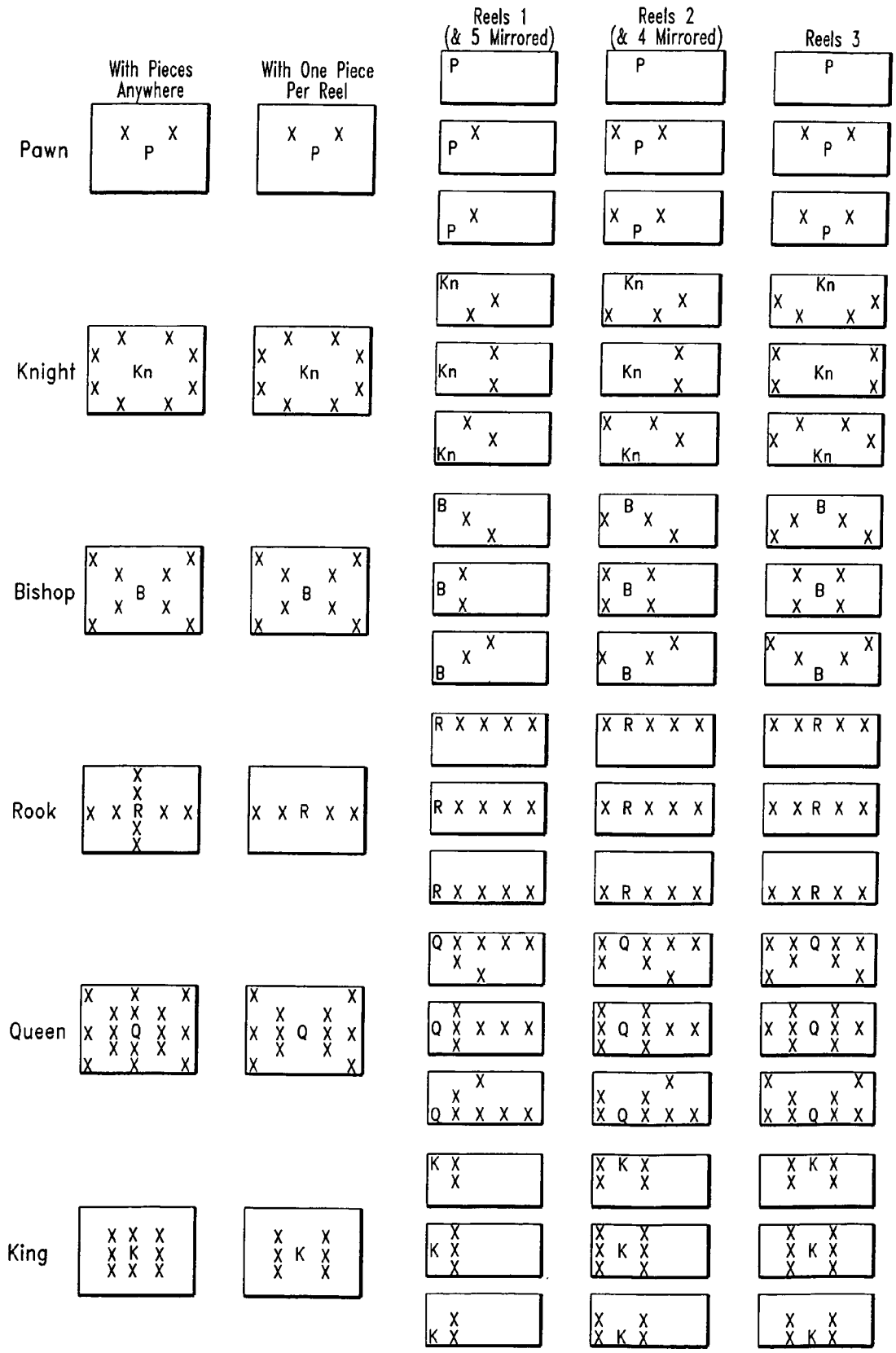
FIG. 4 is a chart indicating the movement rules for each chess piece on the playfield.

In addition to the regular symbols for play in the primary game, special symbols for use in the bonus game are present. The special symbols are preferably symbols displaying traditional chess pieces. Each chess piece is capable of movement in the bonus game according to its traditional movement rules preferably for capturing other pieces. For example, pawns may capture by moving one space diagonally. Rooks may move along the same row or column as far as necessary to capture a piece (or pieces) on the playfield. A chart of possible moves for each piece is provided in FIG. 4.

After the primary game concludes, the "bonus" game begins by evaluating the possible moves of each chess piece in turn. All chess pieces are evaluated, preferably one at a time, for potential moves. A moved piece's potential final position is compared to any other displayed piece's initial position to determine if a "capture" is possible according to the rules of chess. If a "capture" is to be made, preferably a vector graphic is displayed (see FIG. 5A) including a highlight demarcation (e.g., circumscribing box) showing the move made, and the player is awarded for that capture. Remaining moves for the capturing piece are evaluated and the player is rewarded for subsequent captures. Each displayed piece is so evaluated, and each capture generates an award due the player. Preferably, the visual depiction of the move does not alter the play piece (symbol) in its position on the matrix. It merely tallies scoring visually, preferably by incrementing the credit count for each "capture".

Figure 5A:
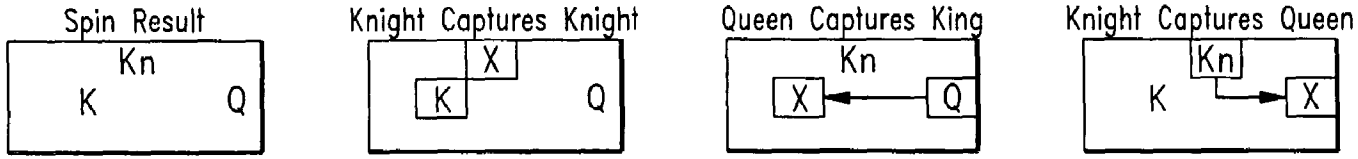
FIGS. 5A and 5B show capture results for example outcomes.

In FIG. 5A, a knight, a king, and a queen are shown on the playfield. All other positions are filled with non-chess pieces. The king can capture the knight, the queen can capture the king, and the knight can capture the queen. The player receives credits for each of the three captures.

Figure 5B:
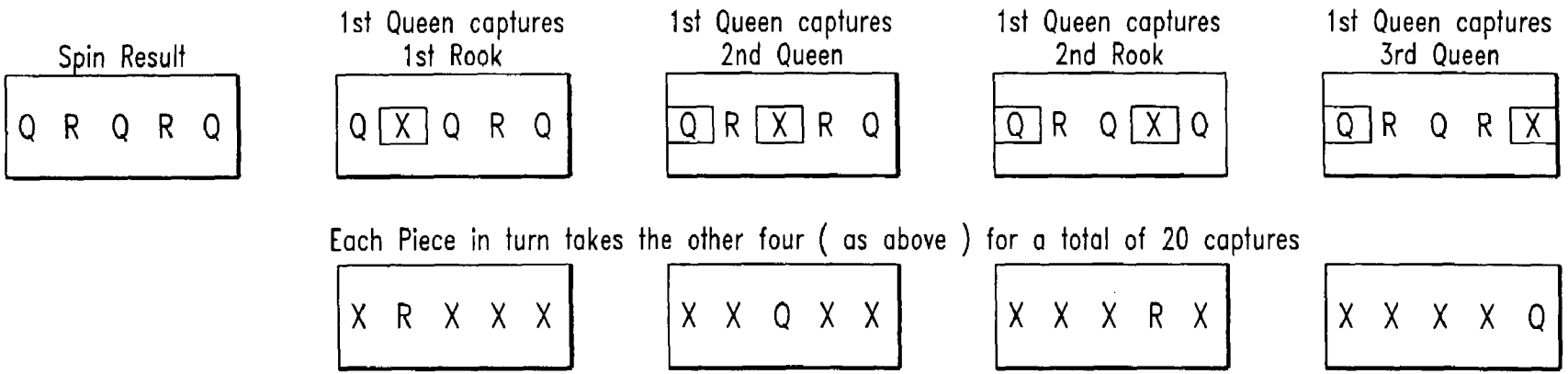

FIG. 5B displays a configuration displaying three queens and two rooks. This configuration produces 20 captures, each of which is awarded. Thus, "multidirectional" capture is possible.

Other embodiments of the chess evaluation are possible. For example, a maximum wager may enable all types of displayed chess pieces for the bonus game, whereas less than a maximum wager may only enable a subset of chess pieces. Each subsequent chess piece may be enabled by a further wager. That is, if a player wagers to enable one payline, the knight is enabled. If 3 paylines are enabled, the bishop is also enabled. If 5, 7, or 9 paylines are enabled, the rook, queen and king are respectively enabled. Only enabled chess pieces may perform captures. Non-enabled chess pieces may be captured, but may not capture. Another embodiment would disallow capture of non-enabled pieces as well.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. A method for displaying a feature in a gaming device, comprising:

(a) displaying a matrix of symbols including symbols for use in a primary game and special symbols for use in a bonus game, said special symbols including representations of chess pieces;

(b) issuing a primary game award where the displayed symbols correspond to a predetermined arrangement;

(c) issuing a bonus game award only where a first chess piece is displayed in the matrix in a position relative to a second chess piece displayed in the matrix such that said first chess piece can capture said second chess piece according to the rules of chess; and (d) repeating step (c) for all possible captures by each displayed chess piece.

2. A method for displaying a feature in a gaming device, comprising:

(a) displaying a matrix of symbols including symbols for use in a primary game and special symbols for use in a bonus game, said special symbols selected from representations of chess pieces having characteristics and movement patterns in the matrix according to the rules of chess;

(b) issuing a primary game award where said displayed symbols correspond to a predetermined arrangement;

(c) evaluating each said displayed special symbol for all possible moves according to the rules of chess, wherein said evaluating includes determining whether the position of said special symbol being evaluated relative to the position of each other of said displayed special symbols results in a possible capture;

(d) issuing a bonus game award only for said possible captures; and (e) issuing a bonus game award for each of said possible captures.

3. A method for displaying a feature in a gaming device, comprising:

(a) displaying a matrix of symbols including symbols for use in a primary game and special symbols for use in a bonus game, said special symbols selected from representations of chess pieces having characteristics and movement patterns in the matrix according to the rules of chess;

(b) providing a primary game in which a primary game award is issued where the displayed symbols correspond to a predetermined arrangement;

(c) providing a bonus game in which each chess piece is evaluated for all possible captures of all other chess pieces according to the rules of chess;

(d) issuing a bonus game award only for said possible captures; and (e) issuing a bonus game award for each of said possible captures.

4. A method for displaying a feature in a gaming device, comprising:

(a) randomly selecting and displaying a matrix of symbols including symbols for a primary game and special symbols for use in a bonus game, said special symbols displayed as representations of chess pieces and interacting according to the rules of chess;

(b) issuing a primary game award where the displayed symbols for said primary game correspond to a predetermined winning arrangement;

(c) evaluating each said chess piece to determine whether said chess piece is positioned relative to another chess piece to effectuate a possible capture according to the rules of chess;

(d) issuing a bonus game award only for said possible captures; and (e) issuing a bonus game award for each of said possible captures.

5. The method of claim 4, further comprising the player making a wager prior to steps (a)-(c).

6. The method of claim 5, further comprising providing a plurality of different special symbols enabled by a maximum wager and a subset of special symbols enabled by less than a maximum wager.

7. A method for gaming, comprising:

accepting a wager;

randomly selecting and displaying game symbols at a display, said game symbols including special symbols representing chess pieces;

issuing an award for a primary game where said game symbols are displayed in a predetermined combination;

evaluating each said displayed special symbol for all possible moves resulting in a capture according to the rules of chess, wherein a capture occurs when a move causes the position of one of said displayed special symbols to coincide with the position of another of said displayed special symbols;

issuing a bonus same award only for said possible captures; and issuing a bonus game award for each of said possible captures.

* * * * *